United States Patent [19]

Martinkó et al.

[11] Patent Number: 4,547,098

[45] **Date of Patent: * Oct. 15, 1985**

[54] MINING EQUIPMENT, MAINLY FOR EXTRACTION OF HEAVY BEDS

[75] Inventors: Mátyás Martinkó, Várpalota; András Elekes, Budapest; Kálmán Simon, Budapest; Józef Bohnert, Budapest; Janós Neméth, Budapest; Károly Bóle, Várpalota; Zoltan Ilyes, Budapest, all of Hungary

[73] Assignees: Kozponti Banyaszati Fejlesztesi Intezet, Budapest; Varpalotai Szenbenyak, Várpalota, both of Hungary

[ * ] Notice: The portion of the term of this patent subsequent to Jun. 19, 2001 has been disclaimed.

[21] Appl. No.: 454,151

[22] Filed: Dec. 29, 1982

Related U.S. Application Data

[63] Continuation of Ser. No. 260,216, May 4, 1981, Pat. No. 4,386,878.

[30] Foreign Application Priority Data

May 6, 1980 [HU] Hungary ..... 1104/80

[51] Int. Cl.[4] ..... E21D 23/00

[52] U.S. Cl. ..... 405/291; 405/296

[58] Field of Search ..... 405/296, 294, 291

[56] References Cited

U.S. PATENT DOCUMENTS 3,902,325 9/1975 Sigoh ..... 405/296
4,020,640 5/1977 Sigoh ..... 405/296

FOREIGN PATENT DOCUMENTS 3026266 2/1982 Fed. Rep. of Germany ..... 405/296

*Primary Examiner*—James A. Leppink
*Assistant Examiner*—Hoang C. Dang
*Attorney, Agent, or Firm*—Karl F. Ross; Herbert Dubno

[57] ABSTRACT

A mine excavator especially for heavy coal beds comprises a base on which the power loader and conveyor are provided and on which the roof support or shield is pivotally mounted. According to the invention, a back member connected to the roof plate and spaced above the base has a downwardly and forwardly swingable door which deposits caved material onto the conveyor at a forward portion of the main base.

6 Claims, 2 Drawing Figures

MINING EQUIPMENT, MAINLY FOR EXTRACTION OF HEAVY BEDS

CROSS REFERENCE TO RELATED APPLICATION

This application is a continuation of application Ser. No. 260,216 filed May 4, 1981, now U.S. Pat. No. 4,386,878.

FIELD OF THE INVENTION

The invention relates to mining equipment which can be used for extraction from heavy beds. The equipment according to the invention is utilizable primarily in coal mines and is described with this in view.

BACKGROUND OF THE INVENTION

It is generally known that extraction methods and equipment for so-called heavy beds in a single process are gaining increasing interest. Attention of the experts is focussed mainly on processes and equipment for the sublevel caving.

Two systems are distinguishable in sublevel caving technology. In one of the systems the equipment has an opening on the sloping back towards the caving-side end, through which the coal can be forwarded to a second conveyor around the central part of the equipment. The first conveyor is at the face-side part of the equipment and its purpose is to carry off the coal extracted by the power loader at a continuous rate. Owing to the two conveyors, such equipment is expensive and the operation and repair require significant cost. The fact that the opening available for the sublevel caving is small represents an additional disadvantage; consequently the sublevel caving process is lengthy and the coal arches over the small opening leading to stoppage of the work. A further significant drawback of the described equipment is that there is not sufficient space for the handling crew, i.e. no clear access can be provided. A further drawback is that the coal falling down at the caving-side end of the equipment can no longer be loaded onto the conveyor, resulting in fairly high losses. In addition such equipment has several other technical and economic deficiencies.

In the other system for sublevel caving technology, the roof plate has a swinging extension bending down backwards externally into the caving. The second conveyor is below this extension. The deficiencies and drawbacks are nearly the same as those described above. Here the open position of the second conveyor is even more disadvantageous. Its repair and maintenance are nearly impossible and dangerous, since the work in the caving must to be carried out at places practically without protection.

OBJECTS OF THE INVENTION

An object of the invention is to provide equipment for the extraction of heavy beds in which a single conveyor is sufficient and with this conveyor the entire coal quantity extracted by the power loader, as well as the amount of coal fed into the equipment through the sublevel caving can be carried off.

Furthermore an object of the invention is to ensure a completely closed formation at the caving-side, and a protected and sufficient manway for the handling crew.

It is yet another object of the invention to give instant protection along the roof and coal face, when the power loader passes by to an appropriate distance.

SUMMARY OF THE INVENTION

These objects are attained with the equipment according to the invention in that the rear base connected to the main base continues through a joint in a combined mechanism the front section of which is formed by the roof plate, while its continuation, i.e. the back section of said combined mechanism by the back units being in force-transferring connection with the roof plate, and a unit turnable or tiltable around the joint is arranged on the caving-side between the back units, which serves as a baffling-chuting door. This baffling-chuting door forms a chute in its tilted down position for the caved coal and its length and angle are selected to be suitable for loading the coal onto the already mentioned conveyor.

The roof plate and the back units in force-transferring connection with the roof plate are connected to the base through a hydraulic prop or a plurality of props and the baffling-chuting unit is movable similarly with one or more hydraulic props built in between the base and baffling-chuting unit.

An advancing roof support is connected to the roof plate supporting the roof above the equipment, and a coal face stakering is connected to this advancing roof support the, coal face stakering being moved similarly with a hydraulic cylinder.

Especially in case of loose rocks it is advantageous to connect a cradle is connected to the base of the equipment and the conveyor, the rail parts guiding the power loader being mounted onto the cradle.

The baffling-chuting door is tiltably mounted between the back units; in its position when it forms a closed back with the back units, it participates in the load bearing transferred by the roof plate to the base. This is ensured by a surface at the conveyor end resting against a counter surface formed in the roof plate and a certain part of the load on the roof plate is taken over along this surface and transferred through the props to the base.

The apparatus according to the invention can be constructed with a shield of any system. The shield described below should be regarded only as an example. In case of a different shield—e.g. so-called lemniscate—the structural specifications and denominations of the structural units are applicable according to the sense of the invention.

The equipment according to the invention—similarly to the known apparatuses—includes the rail units used for guiding the conveyor and power loader.

According to a feature the invention the baffling-chuting door has a contact surface at the end above the conveyor and the roof plate has a counter surface—in the basic position of the baffling-chuting door—resting on the contact surface.

At least one prop is built in between the baffling-chuting door and the base at the equipment according to the invention.

In view of the fact that the apparatuses according to the invention are used in series arranged next to each other it is necessary that no gaps should occur between the apparatuses standing next to each other, through which gaps flushing may occur detrimental to the persons handling the equipment. On the other hand no gaps should remain at the caving-side either. For this reason there are flushing shields at the external surfaces of both the back units and the rear base.

SPECIFIC DESCRIPTION

Figure 1:
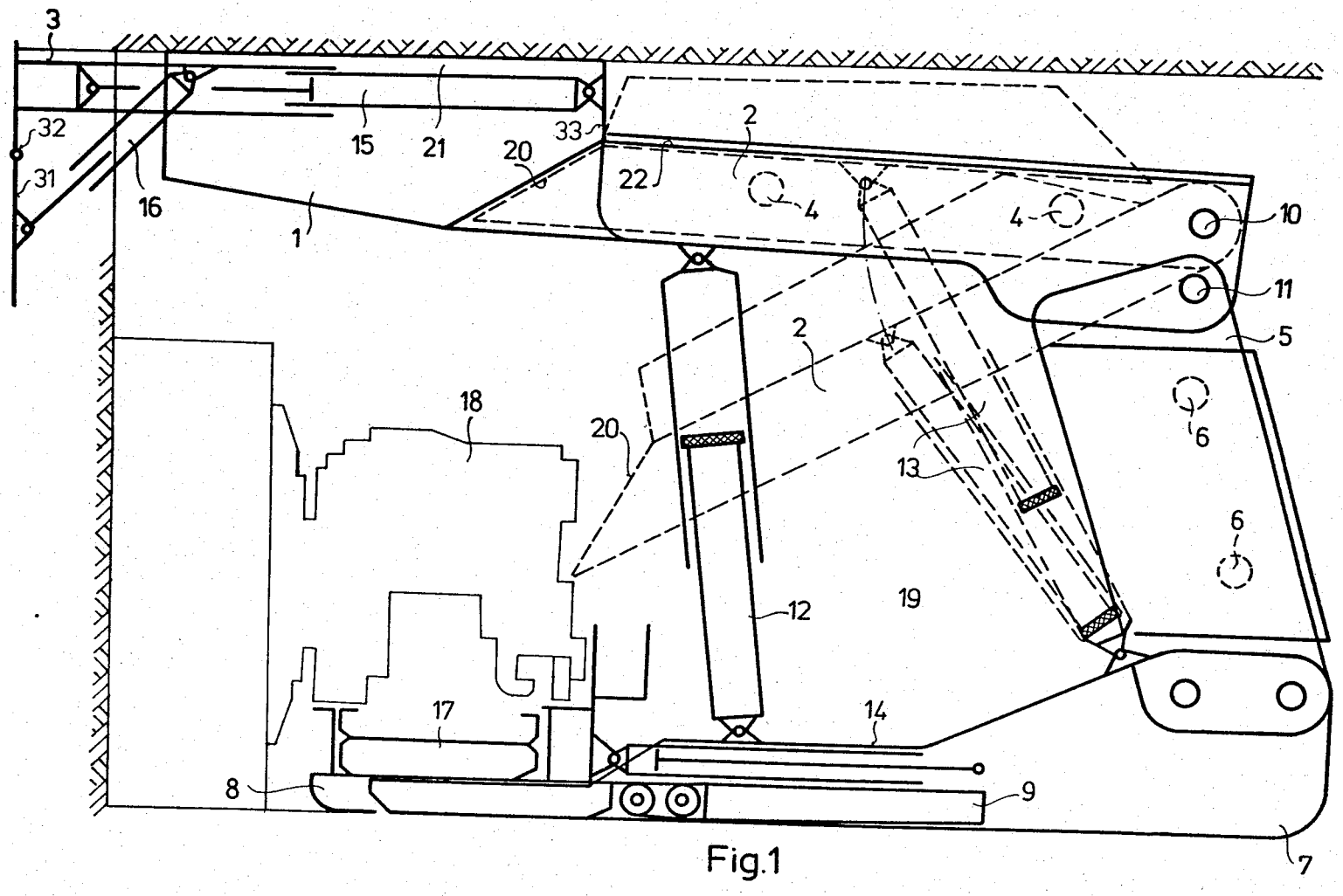
FIG. 1 is a diagrammatic side view of the equipment of the invention.

In the embodiment shown a cradle 8 is connected to a main base 7. The cradle 8 is guided by guide wedges 9. A conveyor 17 is mounted on the cradle 8 which usually is an armoured conveyor. A rail system for guiding a power loader 18 is fixed similarly onto the cradle 8.

A rear base 5 is connected to the caving-side end of the main base 7, to the upper part of which a combined unit or structural part is connected through a pivot or pivots 11 which includes a roof plate and a back. The back consists of back units 22 in rigid connection with the roof plate 21 and of the baffling-chuting door 2 tiltable around a pivot or a shaft 10 in relation to the back units 22. As shown in FIG. 1, the upper part of the roof plate 21 rests on the roof during operation, while the back is located deeper than the supporting horizontal shape of the roof plate 21. Thus there is a fairly wide space between the back and the rock surface above the back. The upper ends of longitudinally adjustable props 12 are articulated to the back units 22, and the lower parts of said props are pivotally connected to the base 7. At the embodiment shown by way of example—as demonstrated in the top view of FIG. 2—a separate prop 12—preferably a hydraulic prop—is associated with to each back unit 22.

The baffling-chuting door 2 is connected similarly with two props 13 to the caving-side of the base 7. Both of the pivotally connected props 13 is longitudinally adjustable and may be formed as a hidraulic prop. The props 13 are pivotally connected to the bottom surface of the baffling-chuting door 2, i.e. to its part lying between the back units 22, symmetrically to the longitudinal axis 30 of the equipment. The points of attachment of the props 13 are preferably closer to a slanting contact surface 20 of the baffling-chuting door 2 then to the pivot 10. The baffling-chuting door 2 can be tilted by the props 13 into the slanting position—shown by dashed lines in FIG. 1. In case of this slanting position the baffling-chuting door 2 functions as a chute and slopes downwardly in the direction of the conveyor 17. FIG. 1 demonstrates that the slanting surface 20 is formed at the left-hand side of the baffling-chuting door 2, i.e. at the end above the conveyor, which is at an acute angle to the basic plane of the back. The counter surface formed in the roof plate 21 rests on this surface 20. This surfaces supporting each other ensure that in the basic position of the baffling-chuting door 2, i.e. in the entirely extended position of the props 13, a certain part of the load on the roof plate 21 is transferred through the baffling-chuting door 2 onto the props 13 and to the base 7 via the props 13.

Thus the baffling-chuting door 2 essentially is a tiltable structural unit formed as a chute which may be regarded as a door, since it serves for closing the opening formed between the back units. The baffling-chuting door 2 in its closed position together with the back units 22 forms the back.

A roof support 3 can be advanced with the help of actuating cylinders 15 to the left at the front part of the roof plate 21, i.e. in the direction of the production, towards the coal face. The actuating cylinders 15 may be formed as hydraulic working cylinder units and arranged closely behind the roof plate 21, but above the upper surface of the back units 22. The actuating cylinders 15 are pivotally connected to a wall 33 between the roof plate 21 and the back. A coal face stakering 31 is pivotally connected to the roof support 3 through a joint 32. The coal face stakering 31 can be pivoted around the joint 32 with the help of a hydraulic cylinder 16, the one end of which is connected to the coal face stakering 31, the other to the roof support 3.

The power loader 18 and its mining disc are shown with thin lines in FIG. 1. Their type in respect of the equipment according to the invention can vary.

In view of the fact that in case of the equipment according to the invention the sequence of such apparatuses mounted next to each other is necessary for the production, thus it is necessary to close the gaps between the apparatuses arranged next to each other, in order to prevent the dangerous flushing through the gaps. Flushing shields 4 connected to the extreme surfaces of the back units 22 are used for closing the gaps between the backs of the adjacent apparatuses and flushing shields 6 are used to cover the gaps formed along the rear base 5. The mentioned flushing shields are conventional devices, i.e. structural elements flexibly displaceable in relation to the adjacent unit of the equipment.

A free space, i.e. the manway 19 between the props 12 and 13 is clearly shown in FIG. 1, in other words this space is reserved for the handling crew of the equipment.

At the equipment according to the invention the upper part of the equipment is formed by such combined structural unit which may be named as roof plate back 1 and which includes the roof plate 21 and the rigidity connected back unit 22 and the baffling-chuting door 2 tiltably mounted around pivots 10 in relation to the back units 22.

Movement of the cradle 8 in relation to the base 7 is ensured by the advancing cylinders 14. These advancing cylinders 14 are used for the conventional advancing processes of the cradles.

Upright flanges may be used at the sides of the baffling-chuting door 2 for the more positive guidance of the rock taking part in the sublevel caving.

Such openings can be formed in the baffling-chuting door, through which it is possible to drill into the rock above the back, i.e. at the caving side of the roof plate 21, for the purpose of blasting in order to provoke the caving of this rock. Thus if a spontaneous breakage of the rock above the back does not occur, then this rock can be broken up and caved by blasting onto the conveyor 17 at the chuting operation mode of the baffling-chuting door 2. At this operation mode, when the baffling-chuting door 2 is in the tilted down position shown with dashed line in FIG. 1, the handling crew can control the production and carry out the necessary work from the adjacent apparatuses of the equipment taking part in the sublevel caving. In case of such blasting sufficient space is available between the back and the rock for the safety of the equipment and handling crew.

The conventional advancing process is made with the use of the equipment according to the invention.

The equipment according to the invention can be realized without cradle too, when for instance the rock conditions at the place of operation allow relatively smaller base surface. Similarly deviation from the embodiment given by way of example is possible in respect of the position and formation of the contact surface 20. Contact surfaces with broken line may also come into useage.

In connection with the equipment described by way of example, following passage of the power loader, the roof and face can be immediately supported by advancing the roof supports 3, or with the aid of the coal face stakering 31 connected to the roof support 3.

In connection with the equipment described it can be stated that a single conveyor 17 is to be used in the equipment and a single conveyor is suitable to carry off the amount of coal extracted by the power loader 18, and the coal loaded onto the conveyor by sublevel caving at the chute position of the baffling-chuting door 2. As a result, the mounting and maintenance work is significantly reduced. The equipment is closed both from above and from the caving-side, thus the interior of the equipment is under protection. The manway 19 for the handling crew is also safe.

It is a significant advantage of the equipment according to the invention that the baffling-chuting door 2 also participates in the load bearing of the roof plate 21 and in the transfer of the load bearing by the surface 20.

When large pieces fall off the coal as a result of caving or blasting, which inhibit the continuous working, then the equipment according to the invention enables the break up of these large pieces by moving to and back the baffling-chuting door 2 with the aid of the props 13.

Figure 2:
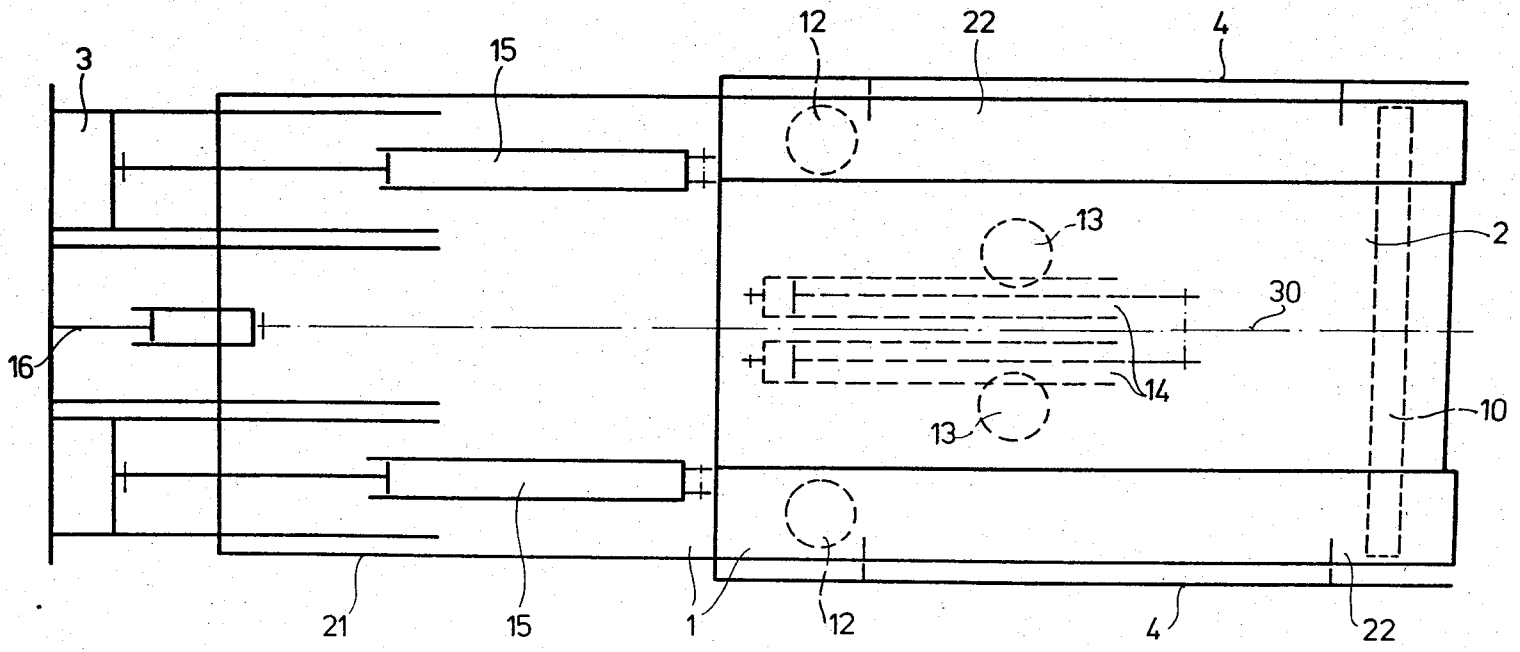
FIG. 2 is a top view of the equipment of FIG. 1.

A very large cross section is available for the sublevel caving at the equipment according to the invention as shown in FIG. 2. In case of the known apparatuses realizing the sublevel caving, the openings for such purpose had much smaller cross section, accordingly, the time of sublevel caving became much longer; on the other hand, the openings were liable to getting blocked during sublevel caving of the large, lumpy coal, as a result of which defects occurred.

Further advantage of the equipment according to the invention is that loss of the extracted material is minimal, since, owing to the closed system, the entire quantity of the useful rock and coal separated by the power loader or by caving is forced onto the conveyor 17.

We claim:

1. A mining apparatus especially for the excavation of a heavy bed at least in part by the caving of a portion of the roof thereof, said apparatus comprising:

a main base displaceable along a mining gallery in the direction of a mining face;

a conveyor mounted on said main base for receiving mineral matter excavated from said face;

a roof plate overhanging a forward portion of said main base and adapted to support the roof of said gallery immediately behind the face during excavation thereof;

a rear base mounted on a rear portion of said main base and extending upwardly therefrom;

a back member pivotally connected to said rear base for tilting movement relative thereto, said back member being connected to said roof plate and overhanging said main base, thereby shielding a portion of said main base from material falling from the roof of said gallery, said back member having a portion forming a door framed by another portion of the back member and tiltable downwardly to form a chute directing caved material from said roof onto said conveyor; and means for pivotally displacing said door relative to the said other portion of said back member to form said chute.

2. The apparatus defined in claim 1 wherein said door has a contact surface formed on an end disposed above said conveyor and said roof plate has a contact surface complementary to and engageable by said contact surface when said door is swung into an upper position.

3. The apparatus defined in claim 1 wherein said means includes a hydraulic prop pivotally connected to said door and said main base.

4. The apparatus defined in claim 1 wherein said back member and said rear base are provided with flushing shields for bridging gaps between the apparatus and adjacent apparatus in said gallery.

5. The apparatus defined in claim 1 wherein a roof support extendable in the direction of said face is connected to said roof plate and is provided with a face stakering pivotally connected thereto.

6. The apparatus defined in claim 1, further comprising a power loader guided on rails on said cradle for excavating said face and depositing the resulting material on said conveyor.

* * * * *